US006705954B2

(12) United States Patent
Takiguchi et al.

(10) Patent No.: US 6,705,954 B2
(45) **Date of Patent: *Mar. 16, 2004**

(54) GOLF CLUB SHAFT AND METHOD FOR MANUFACTURING SAME

(75) Inventors: Ikuo Takiguchi, Toyohashi (JP); Tsutomu Ibuki, Toyohashi (JP); Tetsuya Atsumi, Toyohashi (JP)

(73) Assignee: Mitsubishi Rayon Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/200,097

(22) Filed: Nov. 25, 1998

(65) Prior Publication Data

US 2001/0014626 A1 Aug. 16, 2001

(30) Foreign Application Priority Data

Nov. 26, 1997 (JP) ..... 9-325062
Nov. 24, 1998 (JP) ..... 10-333307

(51) Int. Cl.[7] ..... A63B 53/10
(52) U.S. Cl. ..... 473/319
(58) Field of Search ..... 473/316–323; 428/36.3, 36.9; 264/635; 156/187–188

(56) References Cited

U.S. PATENT DOCUMENTS 5,018,735 A * 5/1991 Meredith ..... 473/318
5,316,299 A * 5/1994 Feche . ..... 473/323
5,354,054 A * 10/1994 Akatsuka et al. ..... 473/289
5,467,984 A * 11/1995 Veux et al. ..... 473/291
3,614,101 A 10/1997 Hunter
5,695,408 A * 12/1997 DeLaCruz ..... 473/300
5,779,559 A * 7/1998 Eberle ..... 473/294
5,813,922 A * 9/1998 Beach ..... 473/319
5,820,480 A * 10/1998 Cheng ..... 473/289
5,957,783 A * 9/1999 Cheng

FOREIGN PATENT DOCUMENTS

JP 9299524 11/1997

* cited by examiner

*Primary Examiner*—Stephen Blau
(74) *Attorney, Agent, or Firm*—Darby & Darby

(57) ABSTRACT

A golf club shaft having an optimal set of materials and sloped sections provides appropriately high rigidity, ease of use, and is inexpensive and easy to manufacture. A sloped section expands toward a grip end of the shaft. The sloped section has a slope gradient from 15/1000 to 35/1000 and a length from 200 to 350 mm. The outer diameter of the grip end is from 18 to 25 mm. On the side of the sloped section toward an end, there is formed a semi-sloped section with a slope gradient from 4/1000 to 13/1000. A kick point is formed at a position from 40% to 46% from the small-diameter end relative to the total shaft length. The number of required parts is small while production is simple. The shaft is light, has appropriate hardness, and high rigidity at the grip. Furthermore, the strength of the shaft is balanced and provides a good feel when hitting a ball. Production of the golf club shaft can be accomplished with standard materials such as fiber-reinforced resins. By wrapping a fiber-reinforced resin around a mandrel and rolling the material on a base which is heated to an optimal temperature, the strength and rigidity of the shaft can be optimized. Multiple layers can be overlaid to provide any desired strength and rigidity required. The rolled shaft is then heated to set the resin and produce a golf club shaft of optimal performance and reduced cost.

4 Claims, 7 Drawing Sheets

Rigidity Distribution Along Shaft

GOLF CLUB SHAFT AND METHOD FOR MANUFACTURING SAME

BACKGROUND OF THE INVENTION

The present invention relates to a shaft for golf clubs (hereinafter referred to simply as shaft). More specifically, the present invention provides a grip region of a golf club shaft with improved rigidity.

In golf clubs, lighter shafts are desirable to improve the head speed during the swing. In addition, improved flexural rigidity at the grip is also desired to improve the feel of impact when striking the ball.

Japanese laid-open utility model publication number 63-133261 and Japanese laid-open utility model publication number 4-44968 disclose fiber-reinforced resin shafts where the rigidity of the shaft is adjusted by providing a member made from fiber-reinforced resin disposed over a section of the shaft.

U.S. Pat. No. 3,614,101 discloses a golf club shaft having a sloped section that expands toward the grip end. The sloped section has a gradient of 28/1000, a length of 254 mm, and an outer diameter at the grip end of 20.57 mm. A semi-sloped section having a slope gradient of 10.79/1000 is disposed closer to the end than the sloped section.

Japanese laid-open patent publication number 9-299524 discloses a fiber-reinforced resin golf club shaft having a tapered section toward the grip, a smalldiameter section toward the head, and a tapered center section. The tapered section toward the grip has a gradient between 2/1000 and 10/1000, a length between 200 mm and 600 mm, and a maximum outer diameter between 18 mm and 37 mm.

The golf club shafts disclosed in Japanese utility-model publication number 63-133261 and Japanese laid-open patent publication number 4-44968 are expensive to make. Both publications teach to use separate members which causes the production process to be complex and also substantially increases the cost of production.

Japanese utility model examined publication number 2529041 discloses another fiber reinforced resin shaft. The rigidity of the shaft is adjusted by having a metal layer disposed on the grip section of the shaft. The use of the metal layer also increases the complexity of the production process and substantially increases costs. Furthermore, since fiber-reinforced resin and metal do not have high adhesiveness, the grip section of the shaft is expected to lack durability.

With the shaft disclosed in U.S. Pat. No. 3,614,101, a straight shaft section approximately 150 mm in length is disposed between a sloped shaft section and a semi-sloped shaft section. At each point along the shaft where the sloped section meets the straight section there is a large change in the flexural rigidity of the golf club shaft. Since the straight section abuts two different sloped portions, the shaft has two locations where there is a large change in the flexural rigidity. When a golfer attempts to swing a club designed according to this method, the club shaft has variations in flexure. The flexure depends on a variety of factors including swing speed, cadence, ability and technique of the golfer's swing. The variations in the flexure of the shaft makes the golf club awkward to use.

Also, in the golf club shaft from Japanese laid-open patent publication number 9-299524 described above, there is a long section toward the end that has a uniform diameter. This section has less flexural rigidity and the kick point is too high. This results in a golf club shaft that is difficult to use.

OBJECTS AND SUMMARY OF THE INVENTION

It is an object of the present invention to provide a golf club shaft which overcomes the drawbacks of the prior art.

It is another object of the present invention to provide an improved grip section in a golf club shaft that overcomes the drawbacks of the prior art.

It is yet another object of the present invention is to provide a golf club shaft and method for producing the same where the rigidity is appropriately high, a kick point is formed at an appropriate position, the shaft is easy to use, and production can be performed inexpensively and easily.

It is an object of the present invention to provide a golf club shaft with a reduced number of parts.

It is another object of the present invention to provide a light weight golf club shaft which has an appropriate hardness and rigidity in the grip section.

It is yet another object of the present invention to provide a light weight golf club shaft with an appropriate hardness and rigidity in the grip section that provides a comfortable feel when hitting a golf ball.

It another object of the present invention to provide a light weight golf club shaft with an appropriate hardness and rigidity in the grip section that minimizes unnecessary wrist movements when hitting a golf ball.

It another object of the present invention to provide a light weight golf club shaft with an appropriate hardness and rigidity in the grip section that provides an appropriate kick point in the shaft.

It another object of the present invention to provide a light weight golf club shaft with an appropriate hardness and rigidity in the grip section that provides a good strength distribution along the shaft.

It is an object of the present invention to form a golf club shaft with a sloped section having a specific slope gradient where production is simplified by reducing the number of required parts. The shaft is light and has appropriate hardness, provides good rigidity at the grip section of the shaft, has good strength distribution along the shaft, and provides an appropriate kick point position along the shaft. The improvements provide a golf club with a good feel when hitting balls. The shaft has a large outer diameter at the grip section which restricts unnecessary movements at the wrists during golf club swinging and thereby improving the aim of the ball.

It is an object of the present invention to provide a golf club shaft having a sloped section with a length of 200–350 mm and a grip end with an outer diameter of 18–25 mm.

It is a further object of the present invention to provide a golf club shaft with a sloped section having a length of 200–350 mm and a grip end with an outer diameter of 18–25 mm which results in improved performance.

It is yet a further object of the present invention to increase the rigidity in the golf club shaft by forming a semi-sloped section at a position further toward the end than the sloped section with a slope gradient of 4/1000–13/1000.

It is yet another object of the present invention to provide a golf club shaft where a golf club head can be easily attached easily to the end of the shaft by forming a uniform-diameter section with a length of 40–125 mm at the end of the shaft.

Briefly stated, the present invention provides for a golf club shaft having an optimal set of materials and sloped sections provides appropriately high rigidity, ease of use, and is inexpensive and easy to manufacture. A sloped section expands toward a grip end of the shaft. The sloped section has a slope gradient from 15/1000 to 35/1000 and a length from 200 to 350 mm. The outer diameter of the grip end is from 18 to 25 mm. On the side of the sloped section toward an end, there is formed a semi-sloped section with a slope gradient from 4/1000 to 13/1000. A kick point is formed at a position from 40% to 46% from the small-diameter end relative to the total shaft length. The number of required parts is small while production is simple. The shaft is light, has appropriate hardness, and. high rigidity at the grip. Furthermore, the strength of the shaft is balanced and provides a good feel when hitting a ball. Production of the golf club shaft can be accomplished with standard materials such as fiber-reinforced resins. By wrapping a fiber-reinforced resin around a mandrel and rolling the material on a base which is heated to an optimal temperature, the strength and rigidity of the shaft can be optimized. Multiple layers can be overlaid to provide any desired strength and rigidity required. The rolled shaft is then heated to set the resin and produce a golf club shaft of optimal performance and reduced cost.

According to an embodiment of the present invention, there is provided for a golf club shaft having a grip end and an other end, comprising: a sloped section expanding toward the grip end, the sloped section having a first slope gradient in a range from 15/1000 to 35/1000, the sloped section having a first length in a range from 200 mm to 350 mm, the grip end having an outer diameter in a range from 18 mm to 25 mm, a semi-sloped section expanding from the other end to the sloped section, the semi-sloped section having a second slope gradient in a range from 4/1000 to 13/1000, the other end having a small diameter, a kick point is located a distance from the small-diameter end, and the distance is in a range from 40 to 46%of a total length of the shaft.

According to another embodiment of the present invention, there is provided for a method for forming a golf club shaft, the steps comprising: wrapping a fiber-reinforced material around a mandrel having a sloped section expanding towards an end of the mandrel to form a wrapped mandrel, applying a first pressure to the wrapped mandrel in a region outside of the sloped section to form a non-pressurized region at the sloped region, applying a second pressure to the non-pressurized region to form a pressurized wrapped mandrel, and heating the pressurized wrapped mandrel to set the fiber reinforced material and form the golf club shaft.

According to yet another embodiment of the present invention, there is provided a method for forming a golf club shaft, the steps comprising: wrapping an inner-layer fiber-reinforced resin material around a mandrel having a sloped section expanding toward an end of the mandrel to form a first wrapped mandrel, the first wrapped mandrel having fibers from the inner-layer fiber-reinforced resin material oriented at an angle in a range from 20 to 70 degrees relative to an axis of the mandrel, heating a rolling base to a first temperature in a range from 30 to 40 degrees C., rolling the first wrapped mandrel on the rolling base at the first temperature to produce a first treated mandrel, the first treated mandrel having the inner-layer fiber-reinforced material adhesed to the mandrel, the step of rolling the first wrapped mandrel includes applying pressure to a section of the mandrel outside the sloped section to form and first non-pressurized region, and applying pressure to the first non-pressurized region, wrapping an outer-layer fiber-reinforced resin material around the first treated mandrel to form a second wrapped mandrel, the second wrapped mandrel having fibers from the outer-layer fiber-reinforced resin material oriented parallel to the axis of the mandrel, heating the rolling base to a second temperature in a range from 20 to 25 degrees C., rolling the second wrapped mandrel on the rolling base at the second temperature to produce a second treated mandrel, the second treated mandrel having the outer-layer fiber-reinforced material adhesed to the inner-layer fiber-reinforced material, the step of rolling the second wrapped mandrel includes applying pressure to a section of the mandrel outside the sloped section to form and first non-pressurized region, and applying pressure to the first non-pressurized region, and heating and setting the second treated mandrel to form the golf club.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

The present invention provides a golf club shaft wherein: a sloped section expanding toward a grip end is formed. The sloped section has a slope gradient of 15/1000–35/1000 and a length of 200–350 mm. The outer diameter of the grip end is 18–25 mm. A semi-sloped section having a slope gradient of 4/1000–13/1000 is formed on the side of the sloped section toward the end. A kick point is formed at a position 40–46% from a small-diameter end relative to the length of the shaft.

It is preferable that the length of the semi-sloped section of the shaft have a length that is 50–80% of the total shaft length. It is also preferred that the shaft have a uniform-diameter section with a length of 40–125 mm formed at the end of the shaft in order to accommodate a golf club head.

A method for making a golf club shaft according to the invention provides that a fiber-reinforced resin material is wrapped around a mandrel. The fiber-reinforced resin material forms a sloped section which expands toward one end.

Pressure is then applied to sections outside the sloped section while forming a non-pressurized region at the sloped section. Subsequently, pressure is applied to the non-pressurized region. Lastly, heating and setting of the material are performed.

Another method for making a golf club shaft according to the present invention provides that in an inner-layer rolling step a fiber-reinforced resin material is wrapped around a mandrel formed with a sloped section expanding toward one end so that the fiber orientation forms a 20–70 degrees angle relative to the axis of the mandrel. The mandrel is rolled on a rolling base at 30–40 degrees C. to adhese the fiber-reinforced resin material to the mandrel. In an outer-layer rolling step, the mandrel on which the fiber-reinforced resin material is wrapped is further wrapped with a fiber-reinforced resin material so that the fiber orientation is parallel to the axis of the mandrel. The mandrel is rolled on a rolling base at 20–25 degrees C. to adhese the fiber-reinforced material. In a heating and setting step, heat is applied to the adhesed materials. During the inner-layer rolling step and the outer-layer rolling step, pressure is applied to sections outside of the sloped section while a non-pressurized region is formed at the sloped section. After the non-pressurized region is formed at the sloped section, pressure is applied to the non-pressurized region.

Figure 1:
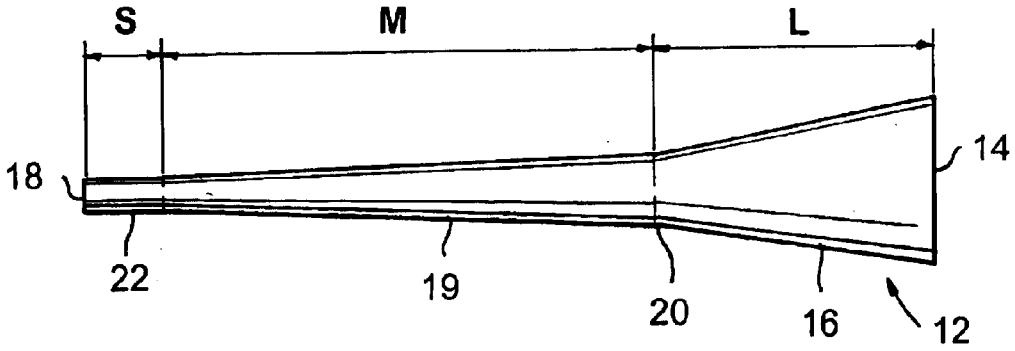
FIG. 1 shows a side-view of a golf club shaft according to the present invention.

FIG. 1 shows a golf club shaft which is made according to the present invention. The golf club shaft has a grip end 14 on one end of the shaft and an end 18 on the opposite end of the shaft. The golf club shaft has a sloped section 16 which is formed on a grip section 12 so that its diameter increases toward a grip end 14. A bend 20 having a changing slope gradient is formed between the sloped section 16 and the end 18. A semi-sloped section 19 is formed between the bend 20 and the end 18.

According to the present invention, the slope gradient of the sloped section 16 is in the range from 15/1000 to 35/1000. In a more preferred embodiment it is desirable for the slope gradient to be in the range from 20/1000 to 30/1000. The presence of the sloped section 16 serves to increase the rigidity of the shaft. Adequate rigidity is difficult to obtain with a slope gradient of less than 15/1000. In addition, a gradient of greater than 35/1000 results in excessive hardness, making it inappropriate for golf club shafts.

The sloped section 16 has a length L which must be in the range from 200 mm to 350 mm. When the length L is less than 200 mm, the improvements to rigidity are small. A length L greater than 350 mm results in a hardness which is excessive and inappropriate for the golf club shaft. In a most preferred embodiment, it is desirable to have as shaft length L in the range from 240 mm to 300 mm.

The grip end 14 of the sloped section 16 must have an outer diameter in the range from 18 mm to 25 mm. If the outer diameter is thinner than 18 mm, then the advantages of improved rigidity are small. If the outer diameter is greater than 25 mm, then the hardness is too high for golf club shafts. An outer diameter of greater than 25 mm also results in the shaft becoming difficult to grip. In a most preferred embodiment, it is desirable to have an outer diameter in the range from 20 mm to 23 mm.

The semi-sloped section 19 spans between the sloped section 16 and the end 18. The end of the semi-sloped section 19 which is closer to the end 18 than the sloped section 16, must be formed with a slope gradient in the range from 4/1000 to 13/1000. It is more desirable for the semi-sloped section 19 to have a slope gradient in the range from 7/1000 to 10/1000. When the slope gradient is less than 4/1000, the rigidity of the semi-sloped section is very low. This loss in rigidity in the semi-sloped section results in the kick point becoming too high, which is inappropriate for golf club shafts. In addition, when the slope gradient is larger than 13/1000, the rigidity near the bend 20 becomes too high, which is also inappropriate for golf club shafts.

It is desirable for the length of the semi-sloped section 19 to be from 50% to 80% of the overall length of the shaft. In a most preferred embodiment it is desirable for the length of the semi-sloped section 19 to be from 60% to 75% of the overall length of the shaft. If the length of the semi-sloped section 19 is less than 50% of the overall shaft length, a section with uniform (equal) diameter would be formed on either the small-diameter side or the large-diameter side of the semi-sloped section 19. If the equal-diameter section is formed on the small-diameter side, a long equal-diameter section is formed at the end 18. This results in a low flexural rigidity for that section, causing the kick point to be formed too high and making it inappropriate for golf club shafts. If the equal-diameter section is formed on the large-diameter side, large changes in flexural rigidity are formed in multiple positions on the shaft, making the shaft difficult to use in hitting balls. If the length of the semi-sloped section 19 is greater than 80% of the overall shaft length then formation of the sloped section 16 which has an adequate length becomes difficult.

The kick point must be at a position which is 40% to 46% of the total length of the shaft from the small-diameter end 18. In a most preferred embodiment, it is desirable to have the kick point at a position which is 41% to 45% of the total shaft length. If the kick point position is less than 40% of the shaft length, the flexural rigidity of the small-diameter section becomes too low which results in decreased strength. If the kick point position exceeds 46% of the shaft length, highly ballistic balls cannot be hit and long flight distance are difficult to obtain.

According to the present invention, it is desirable to have a uniform-diameter section 22 on small-diameter end 18 of the golf club shaft. The uniform-diameter section 22 has a uniform thickness formed at the end on which a golf club head is attached. Attachment is performed by cutting the uniform-diameter section 22 to an appropriate length S and inserting the end 18 into the hole of the golf club head. To accommodate this procedure, it is desirable to have the length S for the equal-diameter section 22 be in the range from 40 mm to 125 mm.

The golf club shaft can be made from standard materials. It is desirable to use metal or composite materials for the golf club shaft.

Metal materials which are useful for a golf club shaft include, but are not limited to, super-high strength steel, martensitic steel, 5% Cr medium carbon steel, alpha+beta titanium alloy, and beta titanium alloy.

Composite materials which are useful for a golf club shaft include various fiber-reinforced materials such as fiber-reinforced metals and fiber-reinforced resins.

The fibers that can be used for fiber reinforcement include, but are not limited to, carbon fiber, glass fiber, aramid fiber, and inorganic fiber. The fibers are formed into a material such as a unidirectional cloth, woven cloth, or a non-woven cloth. In addition to using a single material, it is also possible to use a co-woven material of two or more types.

Fiber-reinforced matrices may include aluminum and iron. Examples of fiber-reinforced resin matrices include thermosetting resins such as unsaturated polyester resin, beer ester resin, and epoxy resin, as well as thermoplastic resins such as acrylic resins and polyamide resins. Of these fiber-reinforced resins, it is most desirable to use carbon fiber reinforced epoxy resin material because it is light and strong.

The shaft does not have to be formed as a single-layer structure. In particular, when fiber-reinforced resin is used, it is desirable to use a multi-layer structure. In a multi-layer fiber-reinforced resin structure, it is desirable to form at least one layer with the fiber oriented parallel to the axis of the shaft, and to have the fibers of the other layers orientated at an angle from 20 to 70 degrees relative to the shaft axis. By using different fiber orientations in a multi-layer fiber-reinforced resin shaft, improved shaft rigidity during the swing can be provided.

The golf club shaft according to the present invention can essentially produced using various standard methods. The following method is desirable.

Figure 6:
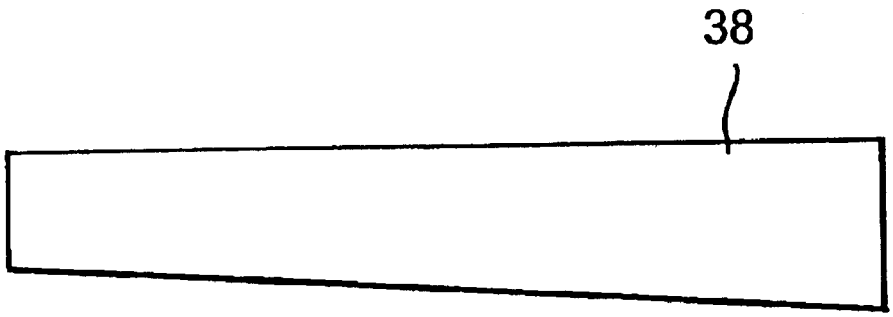
FIG. 6 shows a plan drawing of a fiber-reinforced resin material.

First, a mandrel is formed with a prescribed shape and size having a sloped section expanding toward one end. A shaft material, such as a fiber-reinforced resin material, is cut to a prescribed dimension (e.g., a fiber-reinforced resin material 38 shaped as shown in FIG. 6) and wrapped around the mandrel. This is rolled .along a rolling base to improve the tightness of the fiber-reinforced resin material. The shape of the shaft is determined by the outer shape of the mandrel. To provide a slope gradient of 15/1000 to 35/1000 for the sloped section of the shaft, a mandrel having a corresponding slope gradient of 10/1000 to 40/1000 is used. Similarly, to provide a semi-sloped section with a slope gradient of 4/1000 to 13/1000, a mandrel with a corresponding sloped section having a slope gradient of 4/1000 to 16/1000 is used.

Then, a glass-cloth prepreg is wrapped around the grip section of the shaft. The glass-cloth prepreg prevents the fiber from unraveling during the heating process. The wrapped mandrel with the prepreg is then suspended in a heating furnace to thermoset the fiber-reinforced resin material. After the heating step the mandrel is removed from the now formed shaft. The shaft is polished and painted as needed to produce a fiber-reinforced resin golf club shaft.

Figure 7:
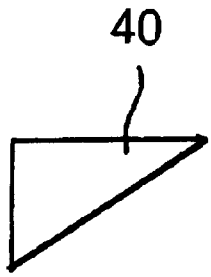
FIG. 7 shows a plan drawing of another fiber-reinforced resin material.

The outer diameter of the end can be made uniform by adjusting the number of layers or the thickness of the fiber-reinforced resin material which is wrapped around the mandrel. Referring to FIG. 7, for example, a triangular fiber-reinforced resin material 40 can be wrapped around the end of the shaft. By providing a greater number of layers toward the end a uniform thickness in the shaft can be achieved at the end.

A golf club is provided by attaching a golf club head and a grip to the resulting golf club shaft.

Figure 2:
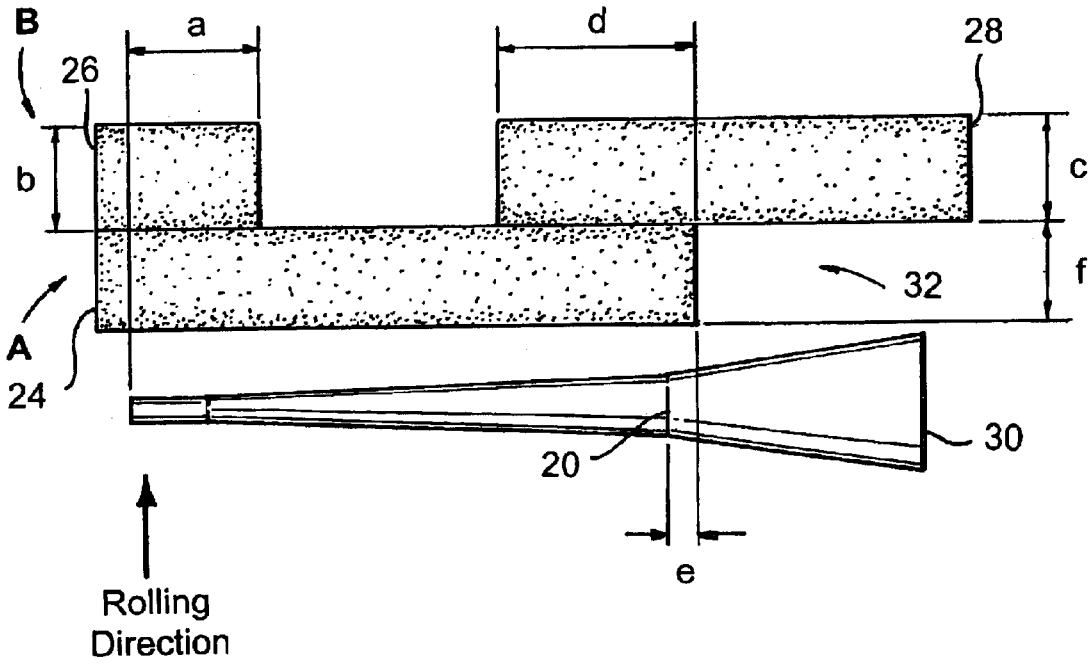
FIG. 2 shows a plan drawing showing the production process of a golf club shaft manufactured according to the present invention.
Figure 3:
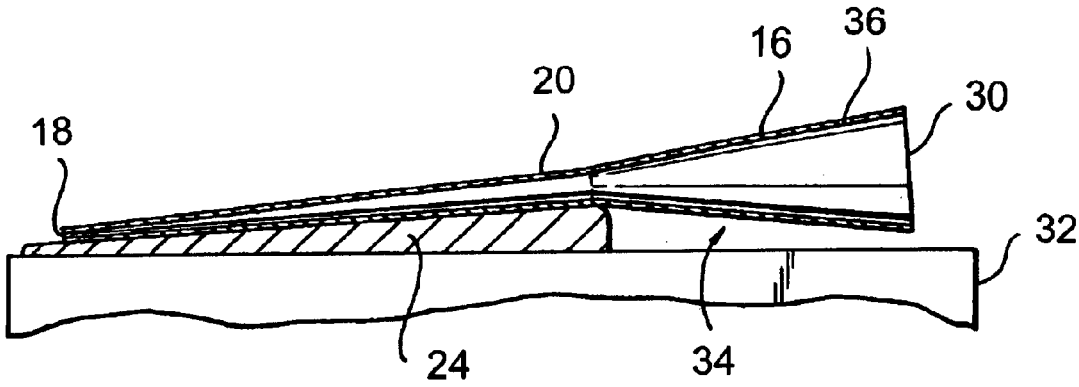
FIG. 3 shows a side-view cross-section of the production process of a golf club shaft manufactured according to the present invention.

According to the present invention, the golf club shaft has a bend 20 along the length of the shaft at the interface between the sloped section 16 and the semi-sloped section 19 (See FIG. 1). The bend in the shaft is achieved by rolling the shaft on a rolling base. Referring to FIG. 2 and FIG. 3, an elastic pad 24 made from a butyl rubber or the like is mounted on a rolling base 32. First, mandrel 30 is pressed against elastic pad 24 and rolled so that pressure is applied to the area between end 18 and bend 20 or the area around bend 20 of sloped section 19. This rolling causes a small-diameter section to be formed without applying pressure to a region 34 of the sloped section 16. Next, mandrel 30 is pressed and rolled on elastic pads 26, 28 which are mounted on rolling base 32 (See FIG. 2 and FIG. 4). This rolling provides application of pressure to the small-diameter section, where pressure is applied around the bend 20 and the end 18 with the pressure being applied to at least the region 34 on which pressure was not applied during the pressing of the small-diameter section.

By first applying pressure to the areas outside of the sloped section and then applying pressure to the sloped section in this manner, it is possible to provide firm wrapping first to the area taking up the greater portion of the overall shaft. Then, when pressure is applied to the sloped section, warping that took place can be eliminated and unevenness can be limited. This also allows the shaft with a bend to be produced with an overall improvement in the tightness at which the fiber-reinforced resin material 36 is wrapped.

Figure 4:
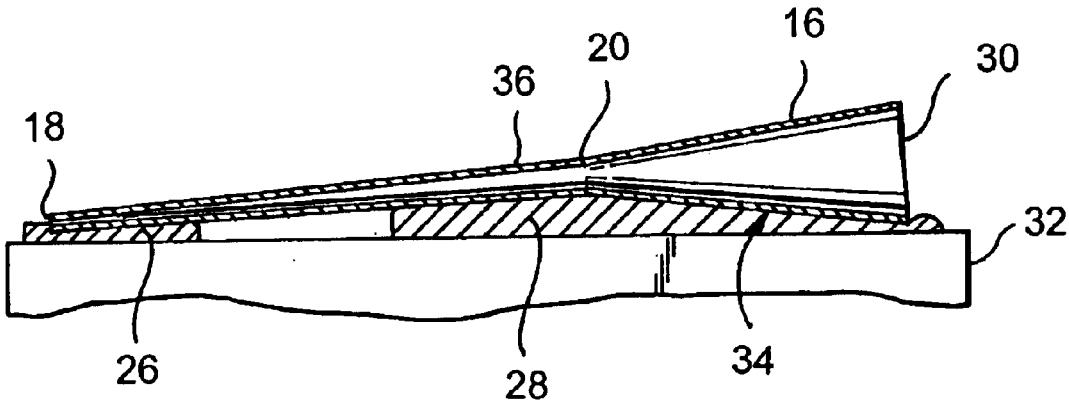
FIG. 4 shows a side-view cross-section of the production process of a golf club shaft according to the present invention.

Referring to FIG. 3, there is shown a cross-section side-view drawing when the mandrel 30 is rotated to a point A in FIG. 2. Referring to FIG. 4, there is shown a cross-section side-view drawing when the mandrel 30 is rotated to a point B in FIG. 2.

A fiber-reinforced resin shaft can also be produced with at least two layers where an inner layer and an outer layer have different fiber orientations. The inner layer and outer later are each wrapped around the mandrel and subsequently rolled on the rolling base in separate operations.

First, in the rolling operation for the inner layer, the fiber-reinforced resin material is wrapped around the mandrel. The inner layer material is wrapped so that the fibers of the material are oriented at an angle of 20 to 70 degrees relative to the axis of the mandrel. Then, the fiber-wrapped mandrel is rolled on a rolling base. It is preferred that the inner layer rolling step is done at a temperature in the range from 30 to 40 degrees C.

Next, in the rolling operation for the outer layer, the mandrel on which the fiber-reinforced resin material was wrapped to form the inner layer is then wrapped with a fiber-reinforced resin material. The outer layer material is wrapped so that the fibers of the material are oriented parallel to the axis of the mandrel. Then, the fiber-wrapped mandrel is rolled on a rolling base. It is preferred that the outer layer rolling step is done at a temperature in the range from 20 to 25 degrees C.

When the fiber-reinforced resin material is wrapped around the mandrel such that the fibers are oriented at an angle from 20 to 70 degrees relative to the axis of the mandrel, the orientation of the fibers result in a high resistance during the step of rolling. By setting the temperature of the base to a temperature in the range from 30 to 40 degrees C., the fiber-reinforced resin material is made softer. Since the fibers are softer, the material can easily be rolled along the shape of the mandrel.

When the fiber-reinforced resin material is wrapped around the mandrel such that the fibers are oriented parallel to the mandrel axis, surface tacking occurs during the step of rolling. By setting the temperature of the base to a temperature in the range from 20 to 25 degrees C., surface tacking is reduced, air bubbles are eliminated and voids are prevented from forming.

As described above, an inner layer is formed with a fiber-reinforced resin material so that the fibers are oriented at an angle relative to the axis of the mandrel, and an outer layer is formed with a fiber-reinforced resin material so that the fibers are oriented parallel to the axis of the mandrel. It is also possible to form an inner layer with a fiber-reinforced resin material so that the fibers are oriented parallel to the axis of the mandrel and to form an outer layer with a fiber-reinforced resin material so that the fibers are oriented at an angle to the axis of the mandrel. However, when the outer layer is formed with a fiber-reinforced resin material with fibers oriented parallel to the axis of mandrel, higher flexural rigidity for the shaft is provided.

Measuring Kick Point

The kick point of a shaft was measured for several embodiments which follow below. The method used in measuring the kick point position along each shaft is described below.

Figure 10A:
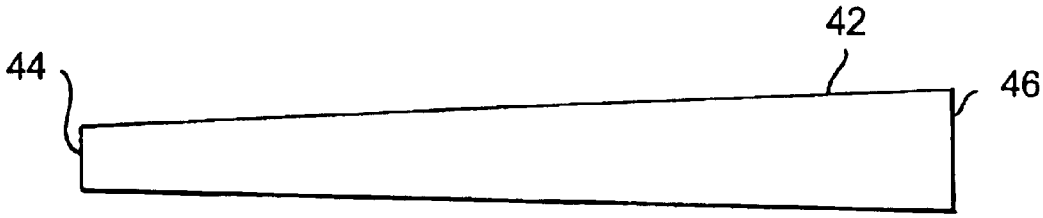
FIG. 10 shows a side-view drawing for the purpose of describing how the kick point was measured.
Figure 10B:
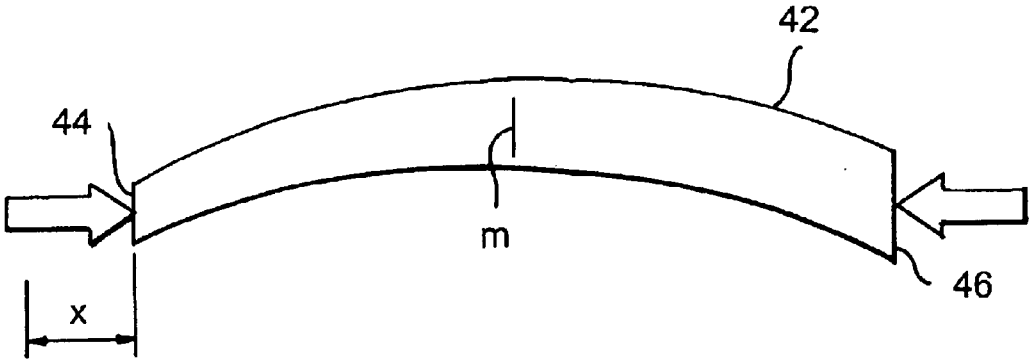
Figure 10C:
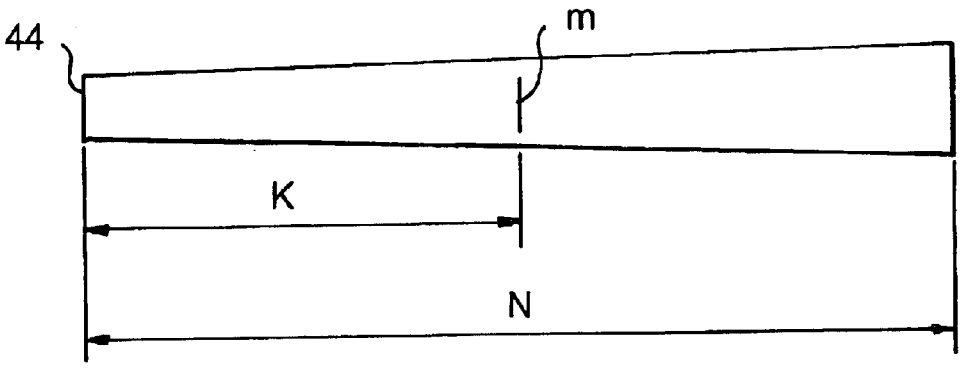

The measurement of the kick point in a sample shaft 42 having an overall length of N is shown in FIG. 10. First, a flexure is produced by applying a compressing force from a small-diameter end 44 and a large-diameter end 46 along the axis of the shaft 42. The compression force is applied to the shaft 42 until the distance between the small-diameter end 44 and the large-diameter end 46 is reduced by 20 mm (designated as X in FIG. 10). When the 20 mm reduction is achieved, the position at which there is most displacement is marked with a mark M. The applied force is then released and the shaft is restored to its full length N. The distance between the mark M and the small-diameter end 44 is measured as length K. Length K is divided by the shaft length N to provide a ratio which serves as the kick point position.

Embodiment 1

A golf club shaft according to the present invention is produced as follows.

A mandrel is used to produce a golf club shaft. The mandrel is formed with a bend point and a sloped section, and has an outer diameter at one end (small-diameter end) of 5.3 mm and an outer diameter at the other end (large-diameter end) of 21.5 mm. The slope gradient between the bend point and the large-diameter end is 21/1000. The slope gradient between the bend point and the small-diameter end is 10/1000.

A releasing agent is applied to the mandrel. A fiber-reinforced resin material is formed from an epoxy resin impregnated with carbon fibers (fiber basis weight: 125 g/m$^2$) cut to prescribed dimensions. These fiber-reinforced resin materials are adhesed to each other to form a fiber-reinforced fabric. The fibers in the fabric consist of carbon fibers oriented at +45 degrees and −45 degrees relative to the axis of the mandrel. The fiber-reinforced fabric is then wrapped around the mandrel forming a wrapped mandrel.

Subsequently, a glass-fiber cloth prepreg is wrapped around the grip section of the wrapped mandrel. The glass-fiber cloth prepreg projects 30 mm to the mandrel. The glass-fiber cloth prepreg prevents the fiber-reinforced resin material from falling off the mandrel during the heating process.

Then, the fiber-reinforced resin material is pressed to the mandrel using a rolling base set to a surface temperature of 35 degrees C. Referring to FIG. 2 and FIG. 3, an elastic pad 24 made from a butyl rubber is mounted on the rolling base 32. The mandrel 30 is rolled over elastic pad 24 so that pressure is not applied to a region 34 while pressure is applied to the sloped section 19 between the end 18 and a bend 20 as well as the area around the bend 20 of the sloped section 16. The rolling process results in the fiber-reinforced resin material 36 being tightly wrapped.

Referring to FIG. 2 and FIG. 4, butyl rubber receiving pads 26, 28 are mounted on the rolling base 32. The mandrel 30 is pressed and rolled over the elastic pads 26, 28 applying pressure to the sloped section 16, including region 34 to which pressure was not applied previously, as well as to the areas around bend 20 and the end 18. This rolling process also results in the fiber-reinforced resin material 36 being tightly wrapped.

The elastic pad 26 is formed as a flat plate having a thickness of 3 mm. The receiving pads 24, 28 are formed as two flat plates having thicknesses of 3 mm stacked on each other. Referring to FIG. 2, length a is 250 mm, length b is 200 mm, length c is 200 mm, length d is 250 mm, length e is 30 mm, and length f is 200 mm.

A fiber-reinforced resin material is formed by cutting a fiber-reinforced resin (basis weight: 150 g/m$^2$), consisting of an epoxy resin impregnated with carbon fibers, to a prescribed dimension. The fiber-reinforced material is wrapped around the mandrel on which the previous fiber-reinforced resin material was applied. The fiber-reinforced resin material is wrapped so that the fibers are oriented parallel to the axis of the mandrel.

Then, the fiber-reinforced resin material is applied to the mandrel in the same manner as described above using a rolling base with set to a surface temperature of 22 degrees C.

Referring to FIG. 7, a triangular fiber-reinforced resin material 40 is wrapped at the end 18 of the shaft. The triangular material 40 provides an increased thickness in the golf club shaft toward the end 18. By using triangular material 40 on end 18, the outer diameter can be adjusted so that it is uniform at the end 18.

After the shaft is formed as discussed above, a polypropylene tape is wrapped at a pitch of 2.5 mm around the shaft. The polypropylene tape maintains the shape of the shaft during forming. The shaft is suspended for 120 minutes in a heating furnace at 140 degrees C. to thermoset the fiber-reinforced resin material.

After the thermosetting step is complete, the polypropylene tape is then peeled off and the mandrel is pulled out. The shaft is now formed. Cutting and polishing is performed as required to produce a two-layer golf club made from carbon fiber-reinforced resin.

With reference to FIG. 1, a resulting golf club shaft was produced with the following dimensions. The golf club shaft has a total length (S+M+L) of 1145 mm. The length L of the sloped section 16 is 245 mm. The length S of the uniform-diameter section 22 is 75 mm. The length (S+M) from the end 18 to the bend 20 is 900 mm. The length M of the semi-sloped section 19 is 825 mm (72% of the total shaft length). The outer diameter of the grip end 14 is 20 mm. The slope gradient of the sloped section 16 is 21/1000. The sloped gradient of the semi-sloped section 19 is 10/1000. The kick point is positioned at 42% from the small-diameter end.

A golf club was produced by attaching a golf club head and grip to the above golf club shaft. When golf balls were hit to test the golf club, it was found to provide a very good, rigid feel.

The rigidity of this golf club shaft was measured according to the distance from the end (tip). The results are shown in FIG. 5.

Figure 5:
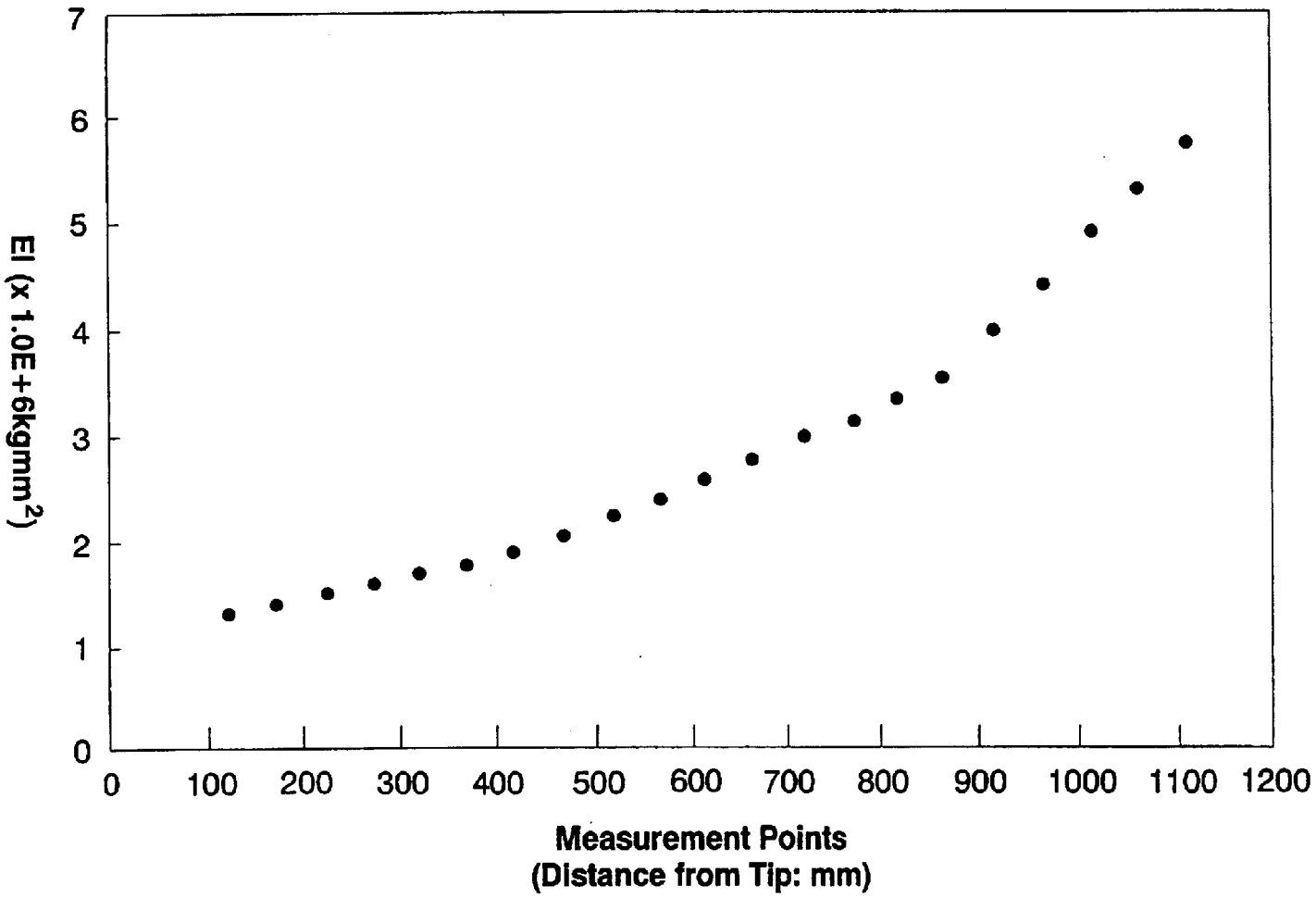
FIG. 5 shows a graph of flexural rigidity along the length of a golf club shaft according to the present invention.

Referring to FIG. 5, it can be seen that the flexural rigidity at the sloped section is very high. A golf club having this type of rigidity distribution is very easy to handle.

Comparative Example 1

A golf club shaft was produced in the same manner as described above using a mandrel having an outer diameter at one end (small-diameter end) of 4.6 mm and an outer diameter at the other end (large-diameter end) of 13.5 mm. A slope gradient of 5/1000 is formed between the bend point and the large-diameter end. The slope gradient between the bend point and the small-diameter end is 8/1000.

In the resulting golf club shaft, the outer diameter of the grip end 14 is 15.3 mm, the length of the sloped section 16 is 265 mm, the slope gradient of the sloped section 16 is 5/1000, the length of the uniform-diameter section 22 is 75 mm, and the slope gradient of the semi-sloped section 19 is 8/1000. The kick point is positioned at 43% from the small-diameter end.

A golf club was produced by attaching a grip and a golf club head to this shaft having a sloped section with a small slope gradient. When balls were hit to test the golf club, it was found that the club gave a negative impression of being weak.

Comparative Example 2

A golf club shaft was produced in the same manner as described above using a mandrel having an outer diameter at one end (small-diameter end) of 4.8 mm. The outer diameter at a position 700 mm from the small-diameter end is 6.2 mm. The outer diameter at a position 234 mm from that position (934 mm from the small-diameter end) is 21.5 mm. The outer diameter at a position 400 mm from that position (the large-diameter end) is 22.8 mm.

Figure 8:
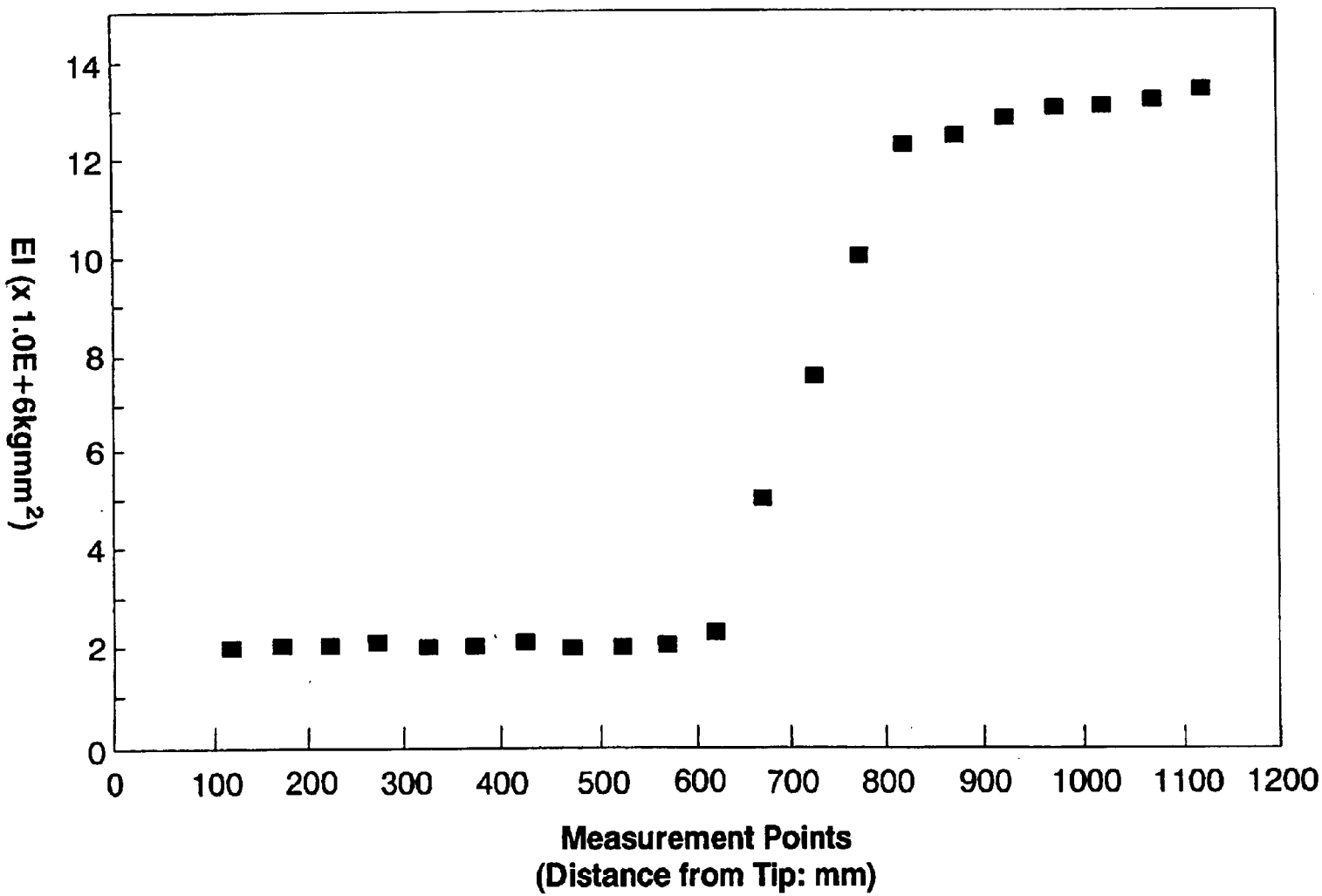
FIG. 8 shows a graph of rigidity along the length of a shaft designed according to comparative example 2.

In the resulting golf club shaft, the outer diameter of the grip end 14 is 25 mm. The outer diameter at the position 300 mm from the grip end is 24 mm. The outer diameter at the position 543 mm from the grip end is 8.5 mm. The outer diameter at the small-diameter end is 8.5 mm. The section from the grip end to a position 300 mm toward the small-diameter end has a slope gradient of 3.3/1000. The section between the position 300 mm from the grip end to the position 234 mm toward the small-diameter end has a slope gradient of 63.8/1000. The length of the uniform-diameter section toward the small-diameter end is 600 mm. The kick point is formed at a position 47% from the small-diameter section. The rigidity distribution of the shaft is shown in FIG. 8.

A golf club was produced by attaching a golf club head and grip to this shaft. When balls were hit to test this golf club, it was found that the rigidity of the grip section was too high. This was because the slope gradient at the grip section is small and a long section of the grip is formed with a large outer diameter. Also, the rigidity of the small-diameter section is low because the uniform-diameter section on the small-diameter side is too long. Thus, the overall balance of rigidity is not good, making it difficult to hit the ball well.

Comparative Example 3

A golf club shaft is produced in the same manner as described in the embodiment above using a mandrel having an outer diameter at one end (the small-diameter end) of 5.6 mm. The outer diameter at a position 775 mm from the small-diameter end is 13.9 mm. The outer diameter at a position 950 mm from the small-diameter end is 13.9 mm. The outer diameter at a position 1250 mm from the small diameter end (the large-diameter end) is 21.7 mm.

In the resulting golf club shaft, the outer diameter of the grip end 14 is 21 mm. The outer diameter at the position 235 mm from the grip end is 15 mm. The outer diameter at the position 410 mm from the grip end is 15 mm. The outer diameter at the small-diameter end is 8.5 mm. The section between the grip end and the position 235 mm toward the small-diameter end has a slope gradient of 25.5/1000. The section between the position 235 mm from the grip end to the position 175 mm toward the small-diameter end has a uniform diameter. The section between the position 410 mm from the grip end to the position 695 mm toward the small-diameter end has a slope gradient of 9.4/1000. The length of the uniform-diameter section toward the small-diameter end is 40 mm. The kick point is formed at a position 41% from the small-diameter end.

Figure 9:
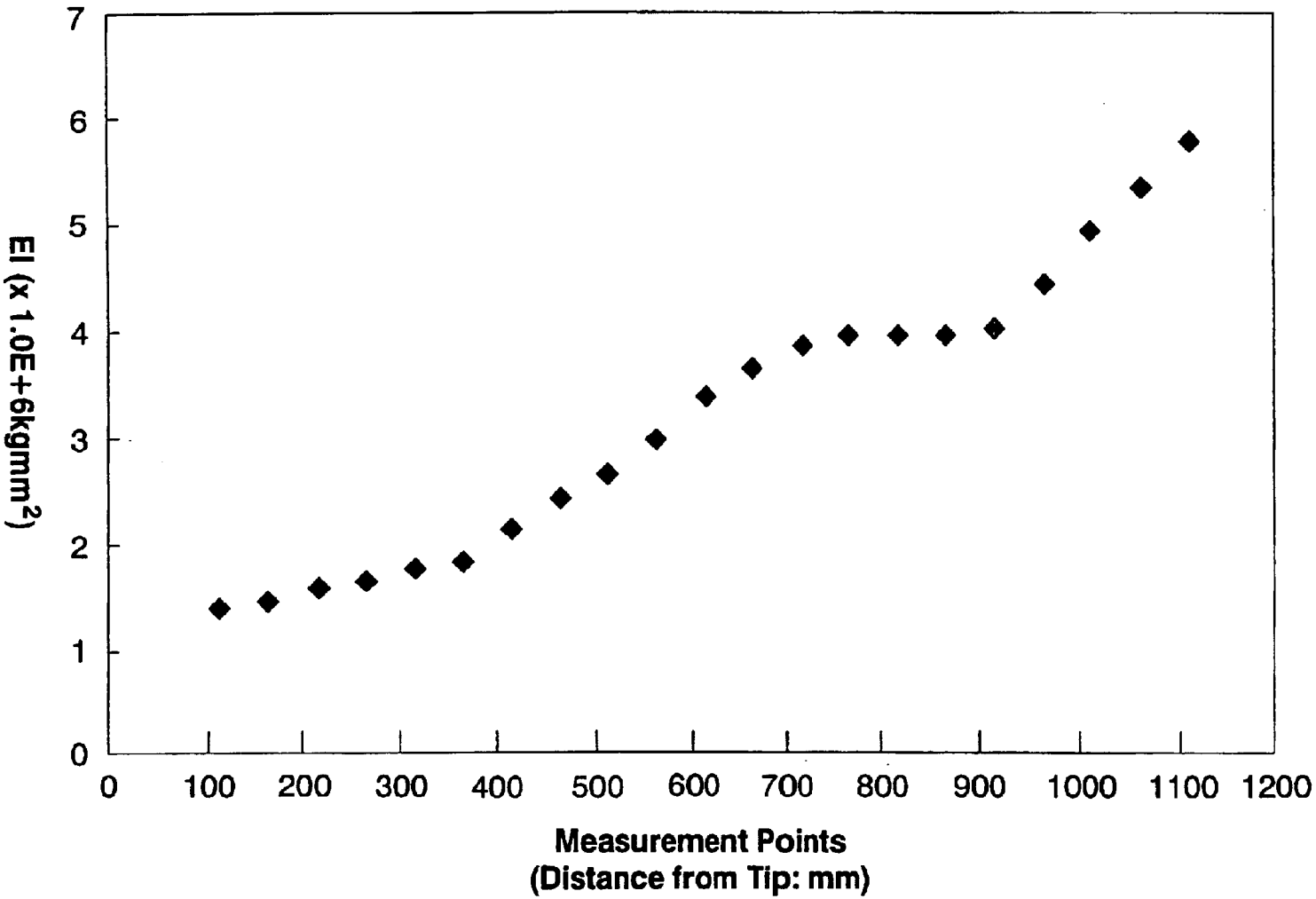
FIG. 9 shows a graph of rigidity along the length of a shaft designed according to comparative example 3.

Referring to FIG. 9, there is shown the rigidity distribution of the shaft.

A golf club was produced by attaching a golf club head and grip to the above shaft. When balls were hit to test this golf club, it was found that a slight change in the way force is applied during the swing results in large differences in shaft flexure. Thus, the club does not provide stable ballistics and is difficult to use.

Advantages of the Invention

When a golf club shaft that is formed with a sloped section having a specific slope gradient as described in the present invention, the number of parts required is small and production is easy. The shaft is light and has appropriate hardness, provides good rigidity at the grip, has good strength distribution, and provides a kick point at an appropriate position. Thus, a good feel is provided when hitting golf balls. Also, since the outer diameter is larger at the grip section, unnecessary movements at the wrists during swinging are restricted, thus improving the aim of the ball.

In particular, using a sloped section with a length from 200 mm to 350 mm and a grip end with an outer diameter from 18 mm to 25 mm improves the above discussed features.

Rigidity can be further increased as appropriate by forming a semi-sloped section at a position further toward the end than the sloped section. The semi-sloped section has a sloped gradient from 4/1000 to 13/1000.

The golf club head can be attached easily by forming a uniform-diameter section with a length from 40 mm to 125 mm at the end.

In the golf club shaft according to the present invention, a mandrel is formed with a sloped section that expands toward one end. A fiber-reinforced resin material is wrapped around the mandrel. Pressure is applied to the sections outside the sloped section so that the sloped section has a region where no pressure is applied. Then, pressure is applied to the region where no pressure was applied. The shaft is then heated and set. As a result, the shaft can be produced easily and reliably.

In golf club shafts having multiple layers, a mandrel is formed with a sloped section that expands toward one end. A fiber-reinforced resin material is wrapped around the mandrel so that the fiber orientation is 20–70 degrees relative to the axis of the mandrel. To perform rolling of an inner layer, the mandrel is rolled on a rolling base at 30–40 degrees C. so that the fiber-reinforced resin material is adhesed to the mandrel. On this mandrel covered with the fiber-reinforced resin material, another fiber-reinforced resin material is wrapped so that the fiber orientation is parallel to the axis of the mandrel. To perform rolling of an outer layer, the mandrel is rolled on a rolling base at 20–25 degrees C. so that the fiber-reinforced resin material is adhesed to the mandrel, and this is then heated and set. During the inner-layer rolling process and the outer-layer rolling process, pressure is applied to the sections outside the sloped section, and a region at which no pressure is applied is formed at the sloped section. Then, pressure is applied to the region at which no pressure was applied. This allows a golf club shaft with high rigidity to be produced easily and reliably.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A golf club shaft having a grip end and an opposite second end, comprising:

a sloped grip section expanding toward said grip end;

said sloped section having a length in a range from 200 mm to 350 mm;

said sloped section having a slope gradient in a range from 15/1000 to 35/1000 across the entire said length;

said grip end having an outer diameter in a range from 18 mm to 25 mm;

a semi-sloped section expanding from said opposite second end toward said sloped section;

said semi-sloped section having a gradient in a range from 4/1000 to 13/1000; and a shaft kick point located from said opposite second end a distance in a range from 40 to 46% of a total length of said shaft.

2. A golf club shaft according to claim 1, wherein said semi-sloped section has a second length that is in a range from 50 to 80% of said total length of said shaft.

3. A golf club shaft according to claim 2, wherein said other end includes a uniform-diameter section having a third length in a range from 40 mm to 125 mm from said other end.

4. A golf club shaft according to claim 1, wherein said other end includes a uniform-diameter section having a third length in a range from 40 mm to 125 mm from said other end.

* * * * *